US011986056B1

(12) United States Patent
Cheney et al.

(10) Patent No.: US 11,986,056 B1
(45) Date of Patent: May 21, 2024

(54) FOOTWEAR HAVING AN ADJUSTABLE LINING

(71) Applicant: FAST IP, LLC, Vineyard, UT (US)

(72) Inventors: Craig Cheney, Lindon, UT (US); Seth Munger, Springville, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/143,909

(22) Filed: Jan. 7, 2021

Related U.S. Application Data

(60) Provisional application No. 62/957,821, filed on Jan. 7, 2020.

(51) Int. Cl.

| | |
|---|---|
| ***A43B 3/26*** | (2006.01) |
| ***A43B 23/02*** | (2006.01) |
| ***A43B 23/07*** | (2006.01) |
| ***A43C 11/14*** | (2006.01) |

(52) U.S. Cl.
CPC ..... *A43B 3/26* (2013.01); *A43B 23/027* (2013.01); *A43B 23/07* (2013.01); *A43C 11/14* (2013.01)

(58) Field of Classification Search
CPC ..... A43B 19/00; A43B 23/07; A43B 23/027; A43B 3/26; A43B 7/1464; A43C 11/14
See application file for complete search history.

(56) References Cited

U.S. PATENT DOCUMENTS

| | | | | |
|---|---|---|---|---|
| 1,633,413 | A * | 6/1927 | Stefano | A43B 7/1464 36/43 |
| 1,830,648 | A | 11/1931 | Engel | |
| 2,112,052 | A | 3/1938 | Smith | |
| 2,776,499 | A | 1/1957 | Guintini | |
| 3,541,708 | A | 11/1970 | Rosen | |
| 4,083,128 | A * | 4/1978 | Rossman | A43B 3/26 36/97 |
| 4,366,629 | A * | 1/1983 | Scherz | A43B 7/32 36/76 R |
| 4,811,500 | A * | 3/1989 | Maccano | A43B 5/00 36/91 |
| 4,813,157 | A | 3/1989 | Boisvert et al. | |
| 4,968,492 | A | 11/1990 | Rosen | |
| 5,036,604 | A | 8/1991 | Rosen | |
| 5,050,319 | A * | 9/1991 | Perotto | A43B 23/26 36/117.6 |
| 5,203,096 | A | 4/1993 | Rosen | |
| 5,241,762 | A | 9/1993 | Rosen | |
| 5,379,529 | A * | 1/1995 | Smith | A43C 11/20 36/50.1 |
| 5,768,803 | A | 6/1998 | Levy | |

(Continued)

FOREIGN PATENT DOCUMENTS

| | | | |
|---|---|---|---|
| CN | 203969442 | U | 12/2014 |
| CN | 108851327 | A | 11/2018 |

(Continued)

*Primary Examiner* — Katharine G Kane

(57) ABSTRACT

Example embodiments of the present disclosure comprise footwear having an adjustable lining. The adjustable shoe may comprise a sole structure, an upper, and an adjustable lining configured to provide for length and/or width adjustability of the shoe. The adjustable lining may be coupled to the upper and may be configured to be moved relative to the upper to adjust a shape and/or a fit of the upper (e.g., change a length and/or a width of the upper).

8 Claims, 5 Drawing Sheets

(56) References Cited

U.S. PATENT DOCUMENTS 5,813,146 A 9/1998 Gutkowski et al.
6,000,147 A 12/1999 Kellerman
6,082,027 A * 7/2000 Wagonhurst ..... A43B 5/0405 36/117.6
6,442,874 B1 9/2002 Long
6,450,510 B1 9/2002 Liu
6,584,707 B1 * 7/2003 Racine ..... A43B 3/26 36/97
6,810,603 B1 * 11/2004 Cosentino ..... A43B 23/17 36/8.3
6,920,707 B1 7/2005 Greene et al.
7,055,268 B2 6/2006 Ha
7,225,563 B2 6/2007 Chen et al.
7,392,604 B2 7/2008 Greene et al.
7,610,696 B2 11/2009 Davis
7,634,861 B2 12/2009 Kilgore
7,917,981 B1 4/2011 Lakic
9,301,571 B2 4/2016 Langvin
9,491,983 B2 11/2016 Rushbrook
9,808,045 B2 11/2017 Carlson et al.
10,159,302 B2 12/2018 Carlson et al.
10,499,707 B2 12/2019 Hobson et al.
10,588,382 B2 3/2020 Rushbrook
10,602,797 B2 3/2020 Lintaman
10,645,990 B2 5/2020 Rushbrook
10,667,579 B2 6/2020 Elder et al.
10,736,379 B2 8/2020 Cook et al.
10,765,170 B2 9/2020 Langvin et al.
10,765,175 B2 9/2020 Panian et al.
10,779,607 B1 9/2020 Chandel
10,827,800 B2 11/2020 Iannuzzi
10,827,803 B2 11/2020 Bell et al.
11,033,072 B2 6/2021 Oda
11,044,962 B2 6/2021 Cheung
2002/0178614 A1 12/2002 Issler
2005/0060913 A1 3/2005 Chil et al.
2006/0107552 A1 5/2006 Clark et al.
2006/0162191 A1 7/2006 Mason
2008/0127518 A1 6/2008 Byrne et al.
2008/0178493 A1 7/2008 Scofield
2008/0296871 A1 * 12/2008 Hsieh ..... A63C 1/26 280/607
2009/0000151 A1 * 1/2009 Cavasin ..... A43B 5/04 36/97
2009/0172972 A1 7/2009 Rosen
2011/0185600 A1 8/2011 Malek
2013/0152426 A1 6/2013 Lederer
2013/0219744 A1 8/2013 Case et al.
2014/0013619 A1 * 1/2014 Irving ..... A43B 3/26 36/71
2014/0020267 A1 * 1/2014 Perez ..... A43B 19/00 36/59 R
2014/0041256 A1 2/2014 Espinola
2014/0123516 A1 5/2014 Cressman et al.
2014/0182167 A1 7/2014 James et al.
2014/0215770 A1 8/2014 Levesque et al.
2014/0237850 A1 8/2014 Hull
2014/0259752 A1 9/2014 Feldman
2014/0259762 A1 * 9/2014 Sukovic ..... A43B 19/00 12/142 R
2014/0338221 A1 * 11/2014 Pride ..... A43B 17/18 36/44
2015/0366288 A1 12/2015 Miller
2017/0027272 A1 * 2/2017 Yeglinski, II ..... A43B 17/003
2017/0056754 A1 3/2017 Yu et al.
2017/0188655 A1 7/2017 Carlson et al.
2017/0231324 A1 * 8/2017 Arquilla ..... A43B 23/07 36/10
2018/0135213 A1 5/2018 Bell et al.
2018/0213884 A1 * 8/2018 Kim ..... A43B 13/127
2018/0242694 A1 8/2018 Webster
2018/0255872 A1 9/2018 Manasiya
2018/0325216 A1 11/2018 Toronjo
2019/0297988 A1 10/2019 Oden et al.
2019/0380430 A1 12/2019 Seid
2020/0008516 A1 1/2020 Chan et al.
2020/0046080 A1 2/2020 Burns et al.
2020/0253334 A1 8/2020 Elder et al.
2020/0329819 A1 * 10/2020 Durand ..... A43B 1/04
2020/0352282 A1 11/2020 Drake
2020/0367604 A1 11/2020 Langvin et al.
2020/0375301 A1 * 12/2020 Cheung ..... A43B 3/26
2021/0037912 A1 2/2021 Spencer
2021/0204639 A1 7/2021 Yang
2021/0219651 A1 7/2021 Rushbrook et al.
2021/0227925 A1 7/2021 Kim

FOREIGN PATENT DOCUMENTS

CN 109549280 A 4/2019
GB 2432295 A 5/2007
KR 100540394 A 12/2005
WO 2006106612 A2 10/2006

* cited by examiner

FOOTWEAR HAVING AN ADJUSTABLE LINING

CROSS-REFERENCE TO RELATED APPLICATIONS

The present application claims priority to and the benefit of U.S. Provisional Application No. 62/957,821 filed Jan. 7, 2020, which is incorporated herein by reference in its entirety.

FIELD

The present disclosure relates to footwear having an adjustable lining.

BACKGROUND

Whether due to growth, pregnancy, injury, swelling or activity (e.g., walking versus running), to name a few, the desired length and/or width of footwear may change over time, and do so before footwear is otherwise "worn out." The present disclosure addresses this need.

SUMMARY

Disclosed herein, in various embodiments, is footwear having an adjustable lining. The adjustable footwear may include a sole structure, an upper coupled to the sole structure, and a lining coupled to at least one of the sole structure and the upper. In various embodiments, movement of the lining relative to the upper is configured to adjust at least one of a size and a fit of the upper.

Also disclosed herein, according to various embodiments, is adjustable footwear comprising a sole structure, an upper coupled to the sole structure, and a lining disposed within a volume defined by the upper and extending at least partially around a perimeter of a footbed. In various embodiments, movement of the lining relative to at least one of the upper and the footbed is configured to adjust at least one of a size and a fit of the upper.

Also disclosed herein, according to various embodiments, is adjustable footwear comprising a sole structure, an upper coupled to the sole structure, and a lining coupled to the upper and configured to extend around at least an interior toe-box region of a volume defined by the upper. In various embodiments, movement of the lining relative to the upper is configured to adjust at least one of a size and a fit of the upper.

BRIEF DESCRIPTION OF THE DRAWINGS

The accompanying drawings may provide a further understanding of example embodiments of the present disclosure and are incorporated in, and constitute a part of, this specification. In the accompanying drawings, only one shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
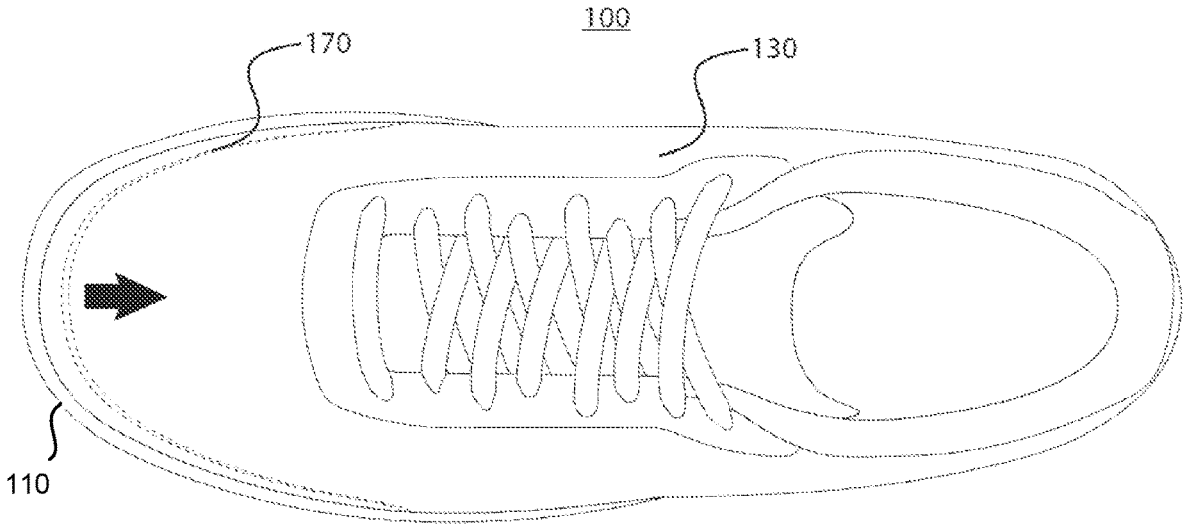
FIG. 1A is a top view of an adjustable footwear having a moveable lining disposed within an upper, in accordance with various embodiments.
Figure 1B:
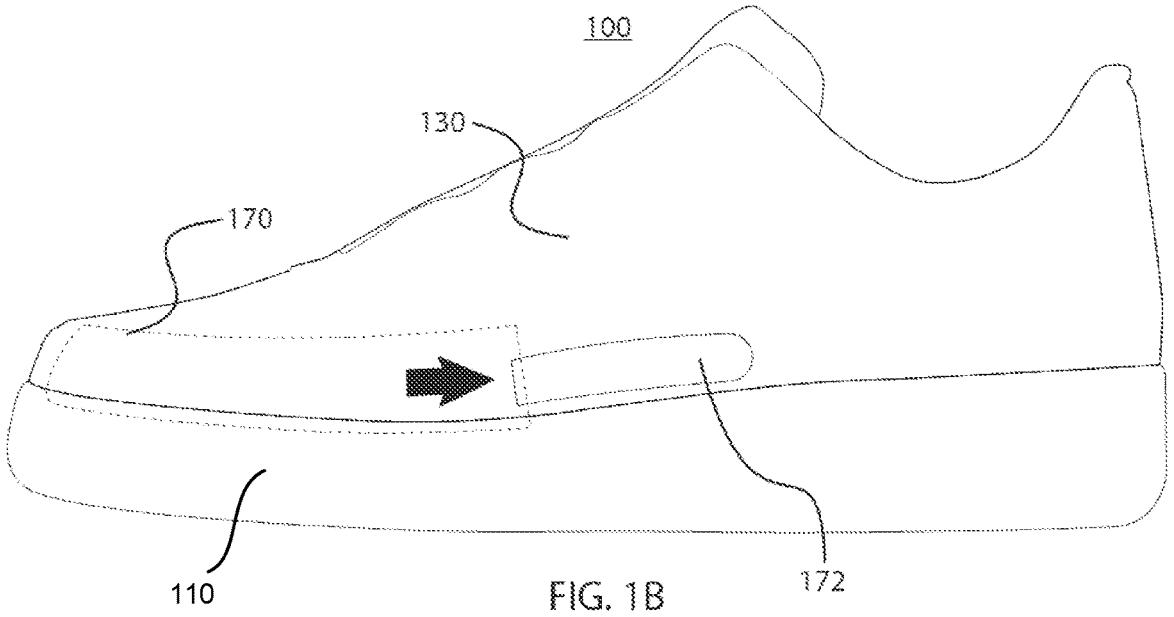
FIG. 1B is a side view of an adjustable footwear having a moveable lining disposed within an upper, with the lining comprising an end exiting the upper, in accordance with various embodiments.
Figure 2A:
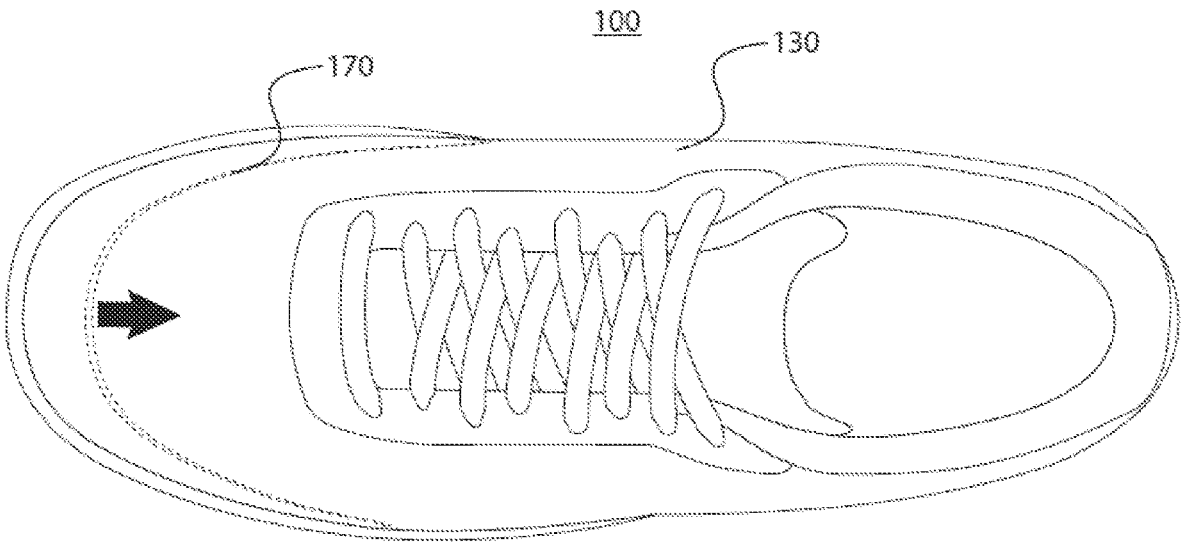
FIG. 2A is a top view of an adjustable footwear having a moveable lining disposed within an upper, in accordance with various embodiments.
Figure 2B:
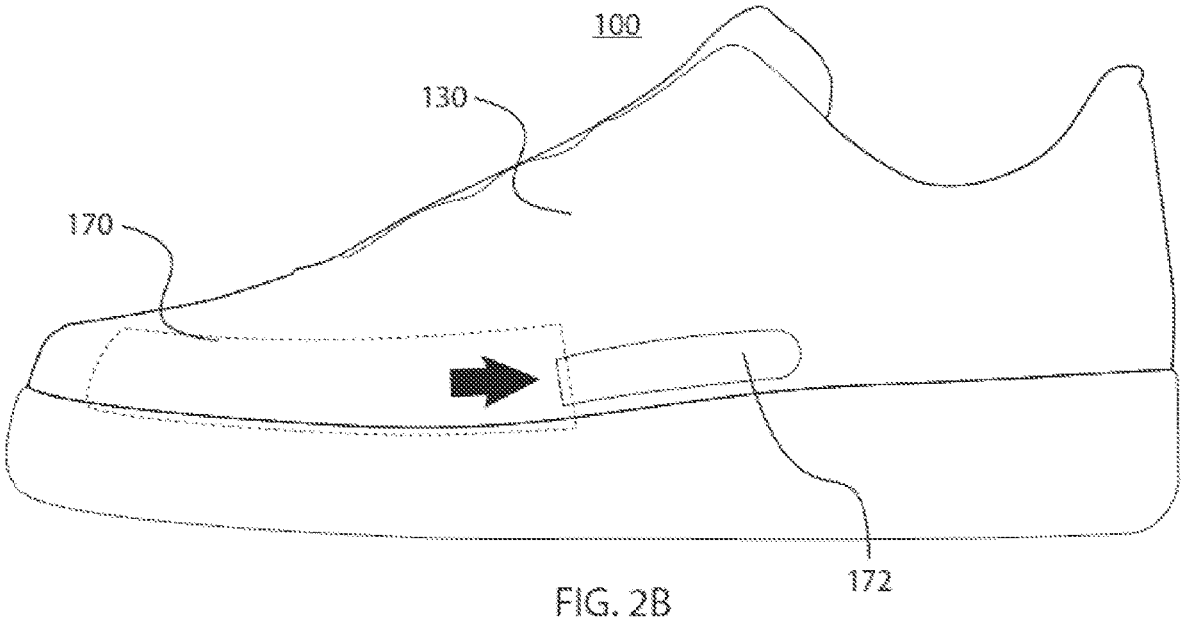
FIG. 2B is a side view of an adjustable footwear having a moveable lining disposed within an upper, with the lining comprising an end exiting the upper, in accordance with various embodiments.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the footwear having an adjustable lining, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the footwear having an adjustable lining. These terms should be given meaning according to the manner in which the footwear having an adjustable lining is most typically designed for use, with the footwear having an adjustable lining on a user's foot and with the user's shod foot disposed on or ready for placement on an underlying surface. Thus, these directions may be understood relative to the footwear having an adjustable lining in such use. Similarly, as the footwear having an adjustable lining is intended primarily for use as footwear, terms such as "inner," "inward," "outer," "outward," "innermost," "outermost," "inside," "outside," and the like should be understood in reference to the footwear having an adjustable lining's intended use, such that inner, inward, innermost, inside, and the like signify relatively closer to the user's foot, and outer, outward, outermost, outside, and the like signify relatively farther from the user's foot when the footwear having an adjustable lining is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, a "footwear" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, footwear can be sized and configured to be worn by men, women, or children.

In accordance with example embodiments, the present disclosure provides for an adjustable shoe comprising a sole structure, an upper, and an adjustable lining configured to provide for length and/or width adjustability of the shoe. Generally, the adjustable lining is coupled to the upper and is configured to be moved relative to the upper to adjust a shape and/or a fit of the upper (e.g., change a length and/or a width of the upper), according to various embodiments.

As used herein, "sole structure" refers to an outsole or portions thereof, a midsole or portions thereof, an insole or portions thereof, a wedge or portions thereof, or other suitable structure disposed between and/or adjacent to the foregoing parts of a shoe. A sole structure herein may comprise one or more of nylon, acetal homopolymer/polyoxymethylene, aluminum, graphite, thermoplastic polyurethane (TPU), thermoplastic copolyester elastomer (TPC-ET), polypropylene, acrylic resin, rubber, titanium, acrylonitrile butadiene styrene (ABS), and polycarbonate. Such a material may comprise a shape-memory material.

With reference to FIGS. 1A, 1B, 2A, and 2B, a shoe 100 comprises a lining 170 in a forward portion of the shoe 100. The lining 170 may comprise a portion that is anchored to the upper 130 and/or the sole structure 110 and another portion/section that is moveable relative to the upper 130. For example, the lining 170 may be coupled to a lateral side of the shoe within the upper 130 and may extend in an arc shape through the forward portion of the upper, with the arc section/portion of the lining being moveable relative to the upper 130. In various embodiments, as described in greater detail below, the lining may include a section/portion (e.g., end 172) that exits the upper so as to be graspable by a user to allow the user to manipulate the lining 170. For example, the lining 170 may exit the upper 130 on a medial side of the shoe. In various embodiments, the lining 170 can be coupled to a medial side within an upper 130 of the shoe 100, extend in an arc shape through the forward portion, and exit the upper on a lateral side. In still other embodiments, the lining 170 can extend in an arc shape through the forward portion, and exit the upper on both a medial side and a lateral side.

In various embodiments, the lining 170 extends partially through the forward portion of the upper, and thus may not extend entirely around the toe-box. In various embodiments, the lining may be configured to extend at least partially over or under toes of the user. In various embodiments, the shoe comprises a plurality of linings, such as a first lining extending generally along a lateral side of the shoe and a second lining extending generally along a medial side of the shoe.

In various embodiments, movement of the lining relative to the upper may comprise expansion or compression of the lining itself. That is, the lining may be configured to change its effective volume via actuation by a user, thus altering the volume it occupies within the foot volume defined by the shoe. Said differently, the lining may be actuatable to expand or collapse, thus changing the available volume for a foot of the user and thereby changing the size and/or fit of the shoe. For example, the lining may be made from a resiliently flexible/deformable material. In various embodiments, the lining comprises a plurality of slits or ribs that can be adjusted to occupy more space (e.g., project out of a plane or expand the dimensions of a strip of material). The lining 170 can comprise one or more folds, pleats or baffles along its length, to provide for additional adjustment to the depth and/or curvature of the shape.

In various embodiments, the end 172 of the lining 170 may exit the upper through an aperture or gore. The end 172 may be graspable by a user, and may thus include ergonomic features or an ergonomic shape. In various embodiments, the exterior surface of the upper in the vicinity of the aperture may be designed and/or configured to accommodate the end 172 of the lining 170. For example, the upper may include a recess for receiving the end 172 of the lining 170 (e.g., to prevent the end 172 from catching on objects). In various embodiments, the end 172 of the lining 170 is configured to be reversibly locked in place, thus allowing a user to reversibly secure the lining in place once a desired shape, size, and/or fit has been selected by the user. Accordingly, the lining may include a feature configured to be locked, secured, and/or retained in place. For example, the end 172 may include a hook and loop material and the upper may include a complementary patch/segment of corresponding hook and loop material. In various embodiments, the end 172 of the lining may be anchored to the exterior surface of the upper or to the sole structure 110.

While the illustrated embodiment depicts a lining 170 exiting an upper to an external portion of the shoe 100, a lining 170 can be configured to exit an upper to an internal portion of the shoe 100. For example, an end 172 of the lining 170, for adjustment of the depth and/or curvature of the arc shape, can alternatively be accessibly located underneath a footbed of the shoe 100.

In various embodiments, the lining, or at least the end 172 of the lining 170, may be made from a material that is sufficiently rigid so as to enable the user to push on the end 172 of the lining 170 to reverse the movement of the lining 170 relative to the upper 130. Said differently, the lining 170 may be configured to be pushed and/or pulled in order to enable the desired adjustability.

In various embodiments, and with continued reference to FIGS. 1A, 1B, 2A, and 2B, movement of the lining 170 relative to the upper 130 adjusts a depth and/or curvature of the arc shape of the lining 170. In various embodiments, an action of the user may produce an adjustment to a width and/or a length of the upper. In various embodiments, a single action taken by the user adjusts both a width and the length of the upper (or at least the defined foot volume of the upper).

Figure 3A:
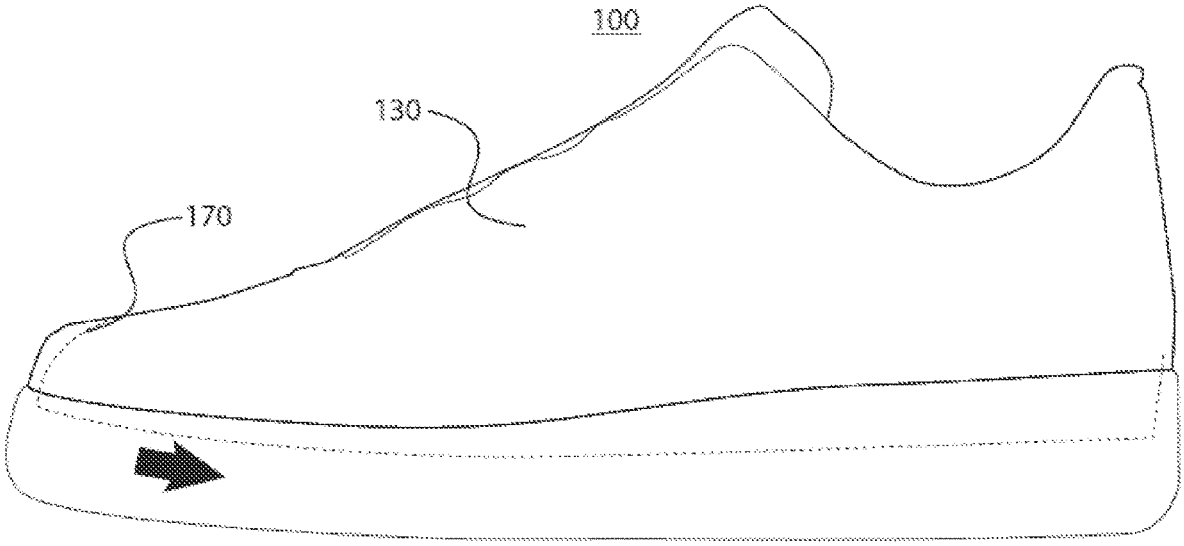
FIGS. 3A and 3B are side views of an adjustable footwear comprising a moveable lining disposed within and extending along a bottom surface of a volume defined by an upper, in accordance with various embodiments.
Figure 3B:
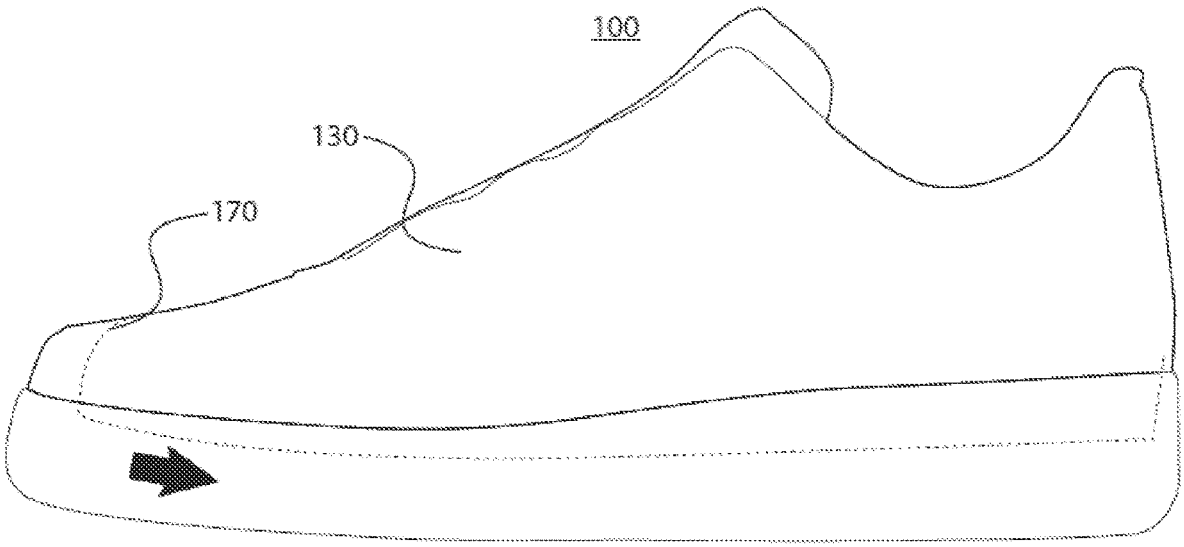

In some embodiments, the lining 170 is coupled to a bottom side within an upper 130 of the shoe 100, extends through the forward portion, and exits the upper on a top side (e.g., proximal to a tongue portion). In other embodiments, and with reference to FIGS. 3A and 3B, the lining 170 is coupled to a top side within an upper 130 of the shoe 100, extends through the forward portion, and exits the upper on a bottom side (e.g., accessibly located underneath a footbed of the shoe 100).

Figure 4A:
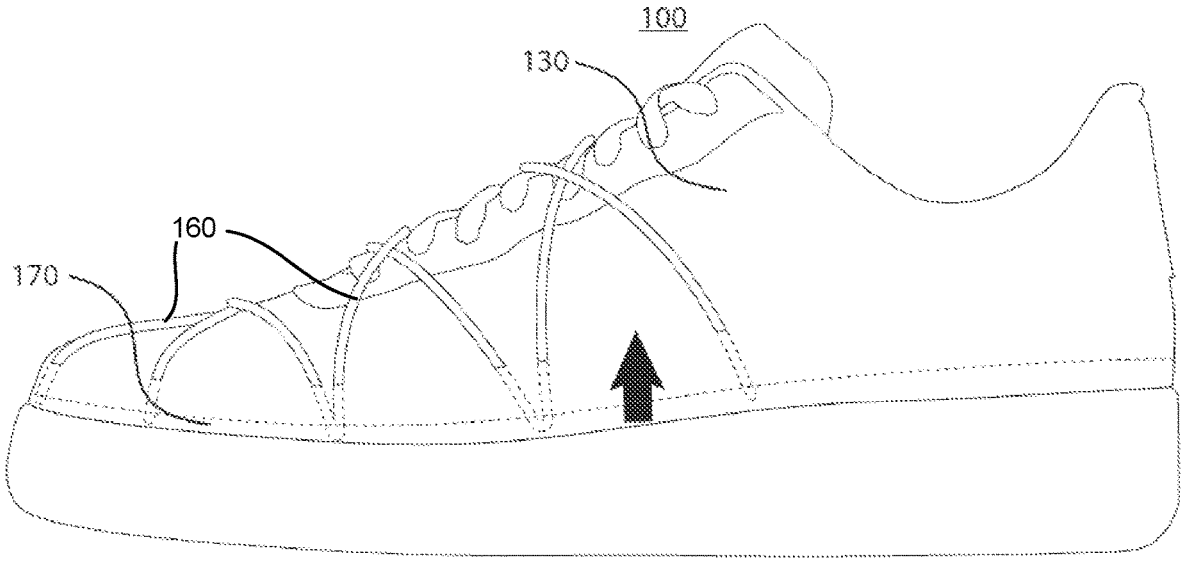
FIGS. 4A and 4B are side views of an adjustable footwear having a lining that extends around a perimeter of a footbed, in accordance with various embodiments.
Figure 4B:
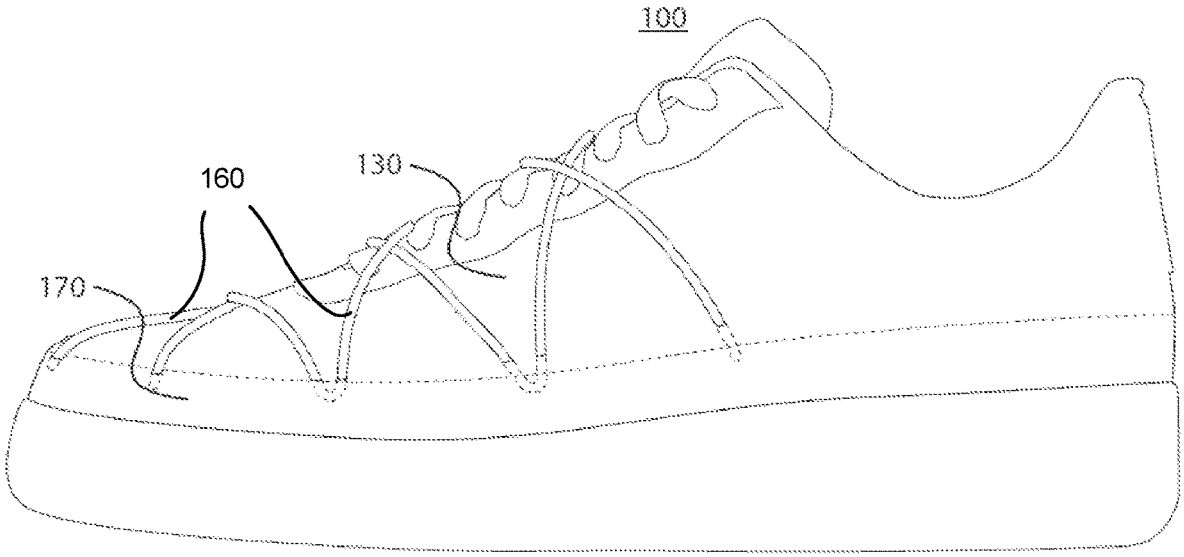

In various embodiments, and with reference to FIGS. 4A and 4B, the lining 170 extends all or partially (i.e., intermittently) around a perimeter of a footbed. In this regard, in connection with the foregoing embodiments, the lining 170 can be raised or lowered like a curtain, to adjust width and/or girth of the upper 130. In various embodiments, the shoe may further include one or more straps 160 that extend across the exterior surface of the upper that extend through the upper 130 at various locations to connect to the lining 170. The one or more straps 160 may enable the user to adjust various portions/sections of the lining 170, thus allowing the user to spatially customize the dimensions of the upper 130. That is, various portions of the lining 170 may be raised/elevated using specific straps 160 while other portions of the lining 170 may be allowed to fall towards the footbed, thus enabling extensive customizability and adjustability for the shoe.

The shoe 100 may include one or more anchoring features to which the straps 160 can be reversibly attached. In various embodiments, the straps 160 may extend over existing shoe features (e.g., laces, tongue, etc.). In various embodiments, the straps 160 may be coupled to or may otherwise be anchored/engaged with conventional shoe features, such as shoelaces, lace loops, and/or the tongue of the shoe.

Figure 5A:
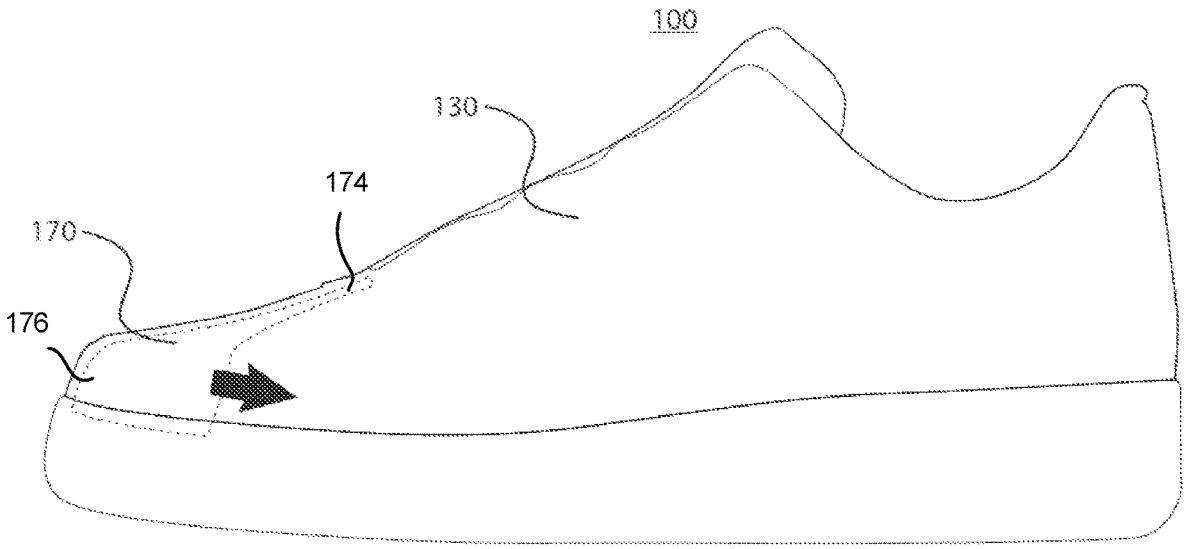
FIGS. 5A and 5B are side views of an adjustable footwear having a lining disposed in a forward portion of an upper, in accordance with various embodiments.
Figure 5B:
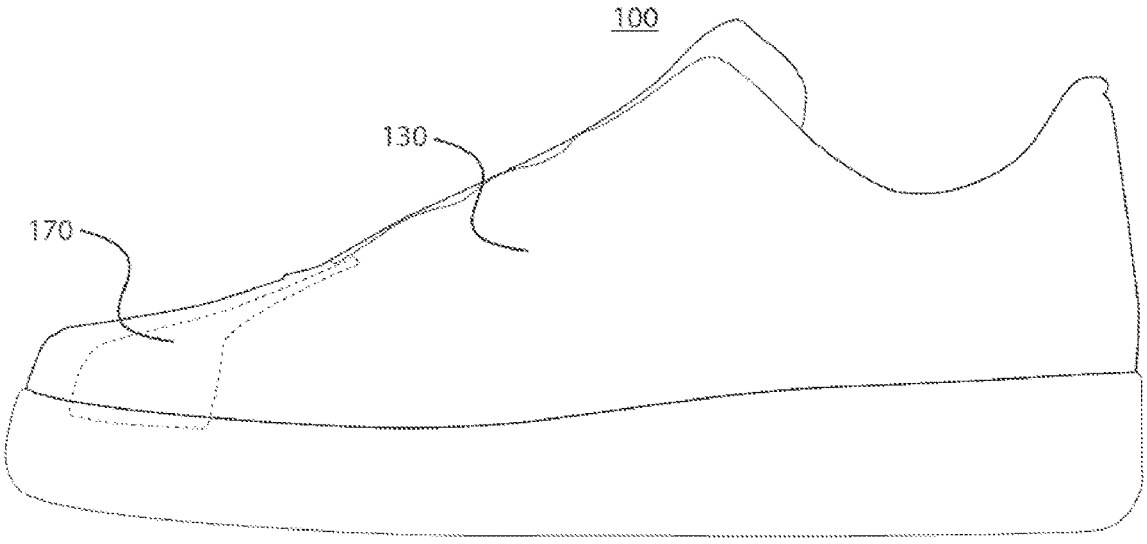

In various embodiments, and with reference to FIGS. 5A and 5B, the lining 170 may comprise a structure configured to be moveably disposed in a forward portion of the shoe 100. The lining 170 may be coupled to a top side of the upper 130 within the volume defined by the upper 130. The lining 170 may be raised and lowered to adjust the dimensions of the interior volume of the upper 130, and/or the lining 170 may be moved forward and rearward to adjust the dimensions of interior volume of the upper 130. In various embodiments, the rearward portion 174 of the lining 170 is coupled at a hinged connection to the upper 130, thus enabling up-and-down movement of the forward portion 176 (i.e., the free end) of the lining 170. That is, the forward portion 176 of the lining may not be directly coupled to the upper 130, but instead is only indirectly coupled to the upper via the rearward portion 174. In other embodiments, the rearward portion 174 of the lining 170 is slideably coupled to the upper 130, thus enabling forward and rearward movement of the lining 170.

A shoe as described herein can have an open configuration, in which the shoe 100 accommodates a larger length and/or width than in a closed configuration.

A shoe as described herein can have a closed configuration, in which the shoe 100 accommodates a smaller length and/or width than in an open configuration.

In some embodiments, the shoe is biased in an open configuration, while in other embodiments, the shoe is biased in a closed configuration. In still other embodiments, the shoe is bi-stable (i.e., in both an open configuration and a closed configuration).

In some embodiments, securement in and/or transition between, open and closed configurations, which may be incremental, is facilitated by one or more of a belt, ratchet (e.g., a zip-tie mechanism), cord, strap with hook and loop fasteners, or the like, in some embodiments with a quick release, surrounding all or a portion of the upper. In other embodiments, securement in and/or transition between, open and closed configurations, is facilitated by an air bladder. In still other embodiments, securement in and/or transition between, open and closed configurations, is facilitated by a cord or the like extending through one or more spaces between upper parts, which may further be driven by a cam system, e.g., including an eccentric wheel. Moreover, a shoe in accordance with the present disclosure may comprise one or more visual, tactile or audible indicators of adjustment (e.g., a click every 2 mm or a mark corresponding to 2 mm).

To further accommodate adjustment to length and/or width of the upper, the upper may be comprised of an expandable material (e.g., a knit, stretch or elastic material), comprise one or more gussets or gores, and/or comprise overlapping or folding panels. Additionally, a footbed of a shoe in accordance with the present disclosure may comprise one or more features to accommodate length and/or width adjustability of the shoe, for example, one or more expandable/collapsible apertures, gussets, gores, overlapping or folding panels, or the like.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. Adjustable footwear comprising:

a sole structure;

an upper coupled to the sole structure, the upper defining an opening for receiving a foot on a top side of the upper; and a lining coupled to the upper;

wherein a second lateral side of the upper comprises an aperture extending therethrough between an inner surface of the upper and an exterior surface of the upper opposite the inner surface;

wherein movement of the lining relative to the upper and through the aperture is configured to alter an interior volume defined by the upper;

wherein the lining is coupled at a first end of the lining to a first lateral side of the upper and extends in an arc shape through the forward portion of the upper, wherein the arc shape of the lining is moveable relative to the upper; and wherein the lining comprises a second end that exits through the aperture defined through the second lateral side of the upper opposite the first lateral side of the upper, so as to be graspable by a user to allow the user to manipulate the lining, and wherein the second end is further configured so as to be temporarily coupled to the exterior surface of the upper while the first end is simultaneously coupled to the first lateral side of the upper.

2. The adjustable footwear of claim 1, wherein the movement of the lining relative to the upper is configured to adjust at least one of a length and a width of the upper.

3. The adjustable footwear of claim 1, wherein the lining is anchored to a forward portion of the upper.

4. The adjustable footwear of claim 1, wherein the exterior surface of the upper is configured to accommodate the second end of the lining.

5. The adjustable footwear of claim 1, wherein the second end of the lining comprises a material that is sufficiently rigid so as to enable the user to push on the second end of the lining to adjust the lining.

6. The adjustable footwear of claim 1, the lining comprises a resiliently flexible/deformable material, wherein the lining is configured such that movement of the lining relative to the upper comprises at least one of expansion and compression of the lining itself.

7. The adjustable footwear of claim 6, wherein the lining is configured to expand or collapse in response to user actuation to change an available volume for a foot of a user within the upper.

8. Adjustable footwear comprising:

a sole structure;

an upper coupled to the sole structure, the upper defining an opening for receiving a foot on a top side of the upper; and a lining having a first end and a second end;

wherein a second side of the upper comprises an aperture extending therethrough between an inner surface of the upper and an exterior surface of the upper;

wherein the lining is coupled at the first end to a first side of the upper opposite the second side and extends in an arc shape through a forward portion of the upper;

wherein the second end exits through the aperture, so as to be graspable by a user to allow the user to manipulate the lining, and wherein the second end is further configured so as to be temporarily coupled to the exterior surface of the upper while the first end remains coupled to the first side of the upper; and wherein manipulation of the lining relative to the upper and through the aperture is configured to alter a dimension defined by the upper.

* * * * *